US005095586A

United States Patent [19]

Wüst et al.

[11] Patent Number: 5,095,586

[45] Date of Patent: Mar. 17, 1992

[54] METHOD OF CHANGING A LAP ROLL IN A COMBING HEAD AND A COMBING HEAD FOR A COMBING MACHINE

[75] Inventors: Oliver Wüst, Seuzach; Robert Demuth, Nurensdorf; Urs Keller, Seuzach, all of Switzerland

[73] Assignee: Rieter Machine Works, Ltd., Winterthur, Switzerland

[21] Appl. No.: 640,650

[22] Filed: Jan. 14, 1991

[30] Foreign Application Priority Data

Jan. 17, 1990 [CH] Switzerland ..... 140/90

[51] Int. Cl.[5] ..... D01E 19/08

[52] U.S. Cl. ..... 19/115 R; 19/225

[58] Field of Search ..... 19/0.25, 115 R, 215, 19/217, 223, 225, 229, 231, 233

[56] References Cited

U.S. PATENT DOCUMENTS

| | | | |
|---|---|---|---|
| 2,559,074 | 7/1951 | Hinson | 19/115 |
| 2,895,177 | 7/1959 | Foster | 19/223 |
| 4,996,747 | 3/1991 | Wichtermann et al. | 19/115 R |
| 5,027,475 | 7/1991 | Mondini et al. | 19/115 R |
| 5,038,441 | 8/1991 | Mondini et al. | 19/115 R |

FOREIGN PATENT DOCUMENTS

| | | | |
|---|---|---|---|
| 0368059 | 5/1990 | European Pat. Off. . | |
| 0328147 | 10/1920 | Fed. Rep. of Germany . | |
| 0890150 | 1/1944 | France . | |
| 2401593 | 3/1979 | France . | |
| 63-42923 | 2/1988 | Japan | 19/115 R |

*Primary Examiner*—Werner H. Schroeder
*Assistant Examiner*—Michael A. Neas
*Attorney, Agent, or Firm*—Francis C. Hand

[57] ABSTRACT

A combing head comprises carrying and drive rollers for the lap roll, a cylinder, a detaching roller pair and nippers reciprocable between a drawn-back position and an advanced position. When the trailing end of the lap material runs off the winding tube, the combing machine is stopped at a time after the detaching roller pair have detached a fringe from the lap in the nippers and after the fringe has been separated from the lap. The lap trailing end and the empty winding tube are then removed and a new lap roll is placed on the carrying and drive rollers. Lap material is unwound from the new lap roll until the start of the lap has passed beyond the nip line of the nippers. The combing machine then restarts. The method can, if required, be performed substantially or completely automatically and calls for only a short machine down time.

12 Claims, 5 Drawing Sheets

METHOD OF CHANGING A LAP ROLL IN A COMBING HEAD AND A COMBING HEAD FOR A COMBING MACHINE

The invention relates to a method of changing a lap roll in at least one combing head of a combing machine. More particularly this invention relates to a combing head for a combing machine.

Heretofore, various types of combing machines have been known for the combing of a lap. Generally, these combing machines have been provided with a multiplicity of combing heads each of which has a pair of nippers for holding a fringe of a lap supplied from a lap roll, a combing cylinder for combing the leading end of the lap and detaching means rollers detaching the combed end from the nippers for supply to a previously combed-out web.

Conventionally, such a combing machine is stopped when the lap has run completely or substantially completely off the lap roll in the combing head or in one of the combing heads. The stoppage can be controlled automatically by detector means such as a photocell or a light barrier which detects when the trailing end of the lap runs off a lap roll. The empty winding tube is then removed and a new lap roll positioned either manually or by a conveyor. The start of the lap of the new roll is then placed manually on the trailing end (which may have been detached to an appropriate length) of the lap from the previous lap roll and joined thereto by being pressed thereon. Thereafter, the machine can restart.

Various techniques have also been employed for replenishing a fresh lap roll to a combing machine. For example, U.S. Pat. No. 2,559,074 describes an apparatus for positioning a fresh supply roll in a combing machine and for effecting the piecing up of the leading end of the fresh lap roll onto the trailing end of the lap from a spent roll. French Patent 2,401,593 and European Patent Application 0368059 describe various techniques for piecing up a fresh lap with the trailing end of a lap employing the detaching rollers of a detachment means.

Other structures have also been known from French Patent 890,150 for delivering fresh lap rolls to a combing machine and from German Patent 328,147 for guiding the trailing end of a lap in a combing machine.

However, piecing-up of a fresh end of a new lap on a trailing end of an old lap imparts an inconsistency in the area of piecing up at least due to an increase in fiber material. This can prove to be disadvantageous in the processing of the combed lap in downstream processing machines.

It is an object of the invention to provide a technique for simplifying lap roll changing in a combing machine without affecting the uniformity of the combed lap.

It is another object of the invention to reduce machine downtime in performing a lap roll change for the combing head of the combing machine.

It is another object of the invention to be able to perform a lap roll change in a combing machine in a substantially or completely automatic manner.

Briefly, the invention provides a method of changing a lap roll in at least one combing head of a combing machine. In this regard, the combing head has lap roll receiving position, a pair of nippers for holding a fringe extending from a leading end of a lap extending from the lap roll, a combing cylinder for combing the held fringe and detaching means for detaching the combed fringe from the nippers.

In accordance with the invention, the method includes the steps of detecting a run-out of the lap from the lap roll, thereafter stopping the combing head at a time after detachment of a combed fringe by the detachment means and thereafter, removing the remainder of the lap extending between the nippers and the lap roll in order to empty the lap roll. Thereafter, the empty lap roll is removed and a full lap roll is positioned in the lap roll receiving position. Next, a fresh lap start from the full lap roll is directed into the nippers and the combing head is thereafter re-started in order to effect combing of a fringe of the fresh lap start in the nippers for subsequent delivery to the detaching means.

The method makes use of the fact that, in normal operation of the combing machine, there is in any case in every combing cycle a separation of the lap from the fibers which the detaching means join to the combed silver and detach from the lap. The combing machine is therefore stopped at a time after the detaching means have detached a fringe from the lap. After removal of the trailing end of the lap still in the nippers and on the empty tube, for example, by suction means, and after positioning of a new lap roll, all that therefore needs to be done is to unwind lap material from the new roll until the start of the lap material has passed beyond the nip line of the nippers. The combing machine then restarts so that the nippers close and return to their withdrawn position and the cylinder combs out the start of the lap material, the detaching means then joining the combed-out start to the combed sliver formed previously. This joining or piecing-up proceeds in the same way as in the normal operation of the combing machine so that virtually no dimensional variations or irregularities of the combed material arise at the joint between the end of the previous lap and the start of the new lap. Such variations and non-uniformity are unavoidable in known processes.

For simultaneous automatic changing of the lap rolls in a combing machine having a number of combing heads, it is advantageous to use, as new lap rolls, prepared lap rolls in which the start of the lap material has a predetermined orientation identical for all the lap rolls. When, therefore, all the new rolls which have been placed on carrying and drive means of the combing heads are turned through the same angle, the starts of the unwound laps pass beyond the nip lines of the nippers substantially simultaneously.

The invention further provides a combing head which is comprised of a lap roll receiving position, a pair of nippers for holding a fringe extending from the lap roll in the receiving position, means for reciprocating the nippers between an open position wherein the nippers are spaced apart to receive a lap therebetween and a closed position wherein the nippers hold a lap therebetween, a combing cylinder for combing a fringe of lap extending from the nippers in the closed position and detaching means for detaching a combed fringe from the nippers. In accordance with the invention, a common drive means is provided for driving the nippers, combing cylinders and detaching means in synchronism. In addition, a stop means is provided for stopping the drive means in response to a run-out of the lap from the lap roll and detachment of the combed fringe by the detachment means. Still further, means is provided for removing the remainder of the lap extending between the nippers and the lap roll receiving position in response to stopping of the drive means as well as means for directing a fresh lap start from a full lap roll into the nippers with the nippers in the open position prior to re-starting of the drive means.

These and other objects and advantages of the invention will become more apparent from the following detailed description taken in conjunction with the accompanying drawings wherein.

Figure 1:
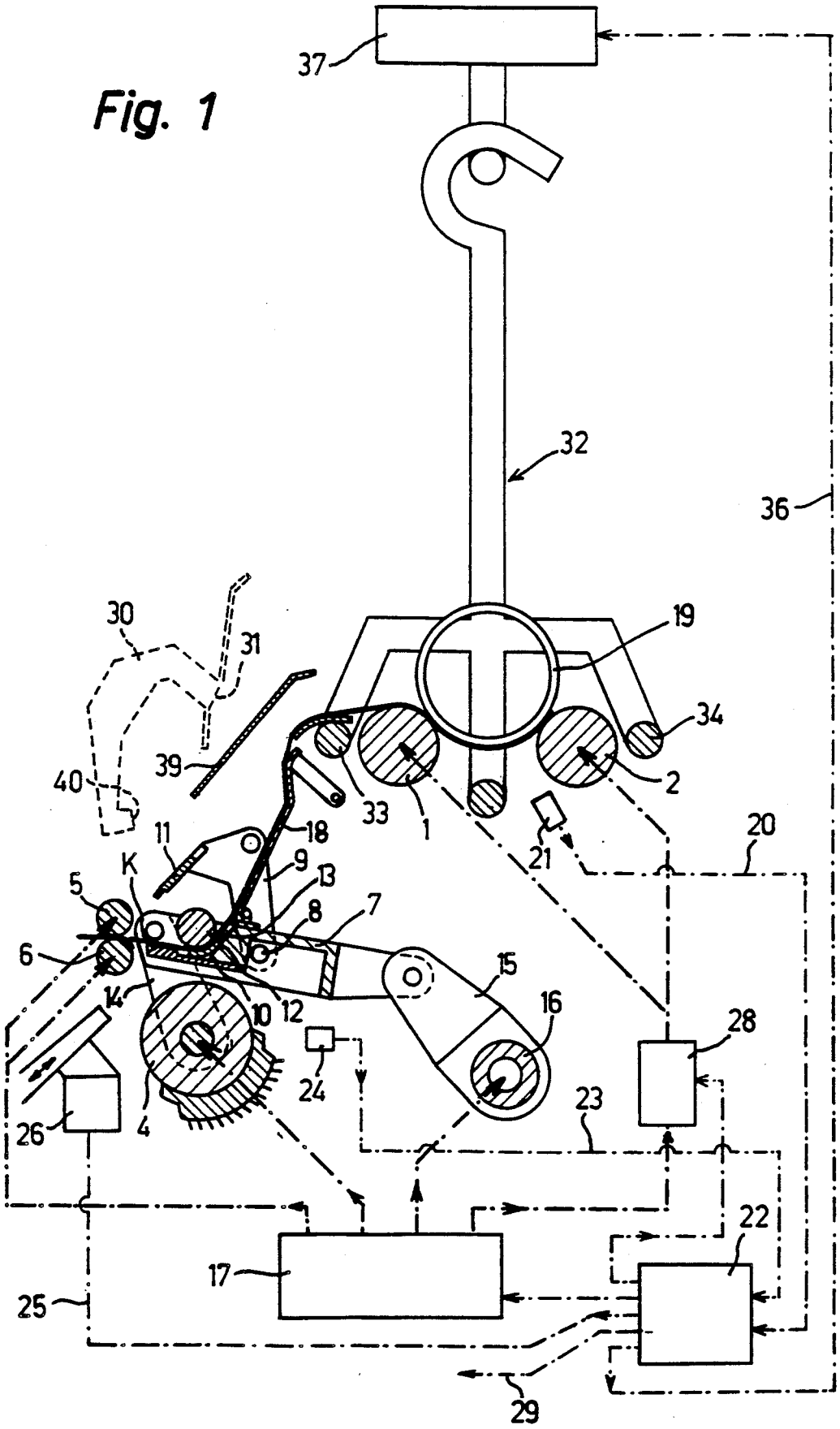
FIG. 1 is a diagrammatic view in vertical section of a combing head constructed in accordance with the invention.
Figure 2:
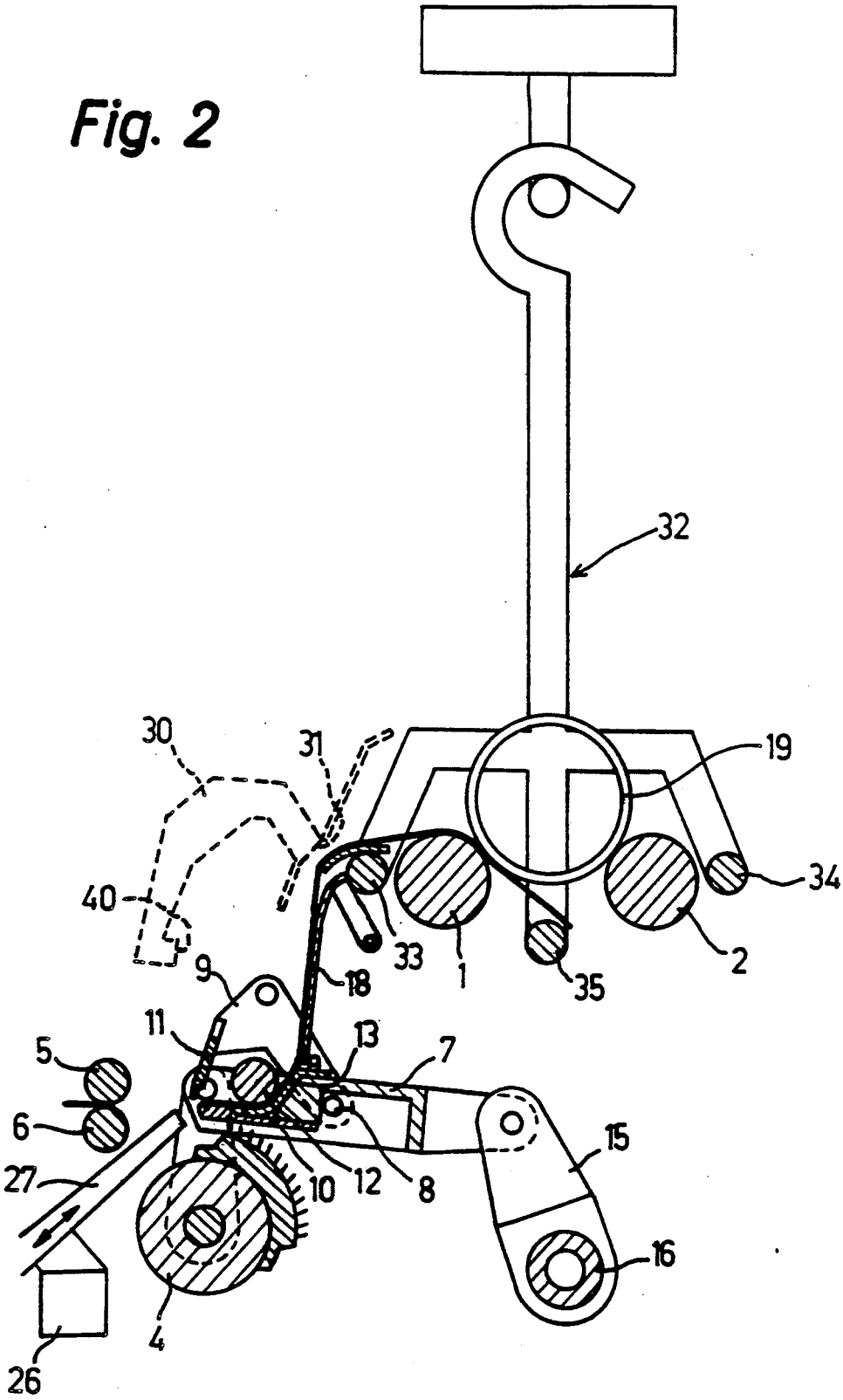
FIG. 2 illustrates a view similar to FIG. 1 at a point in time after a lap has run out at the lap roll position.
Figure 3:
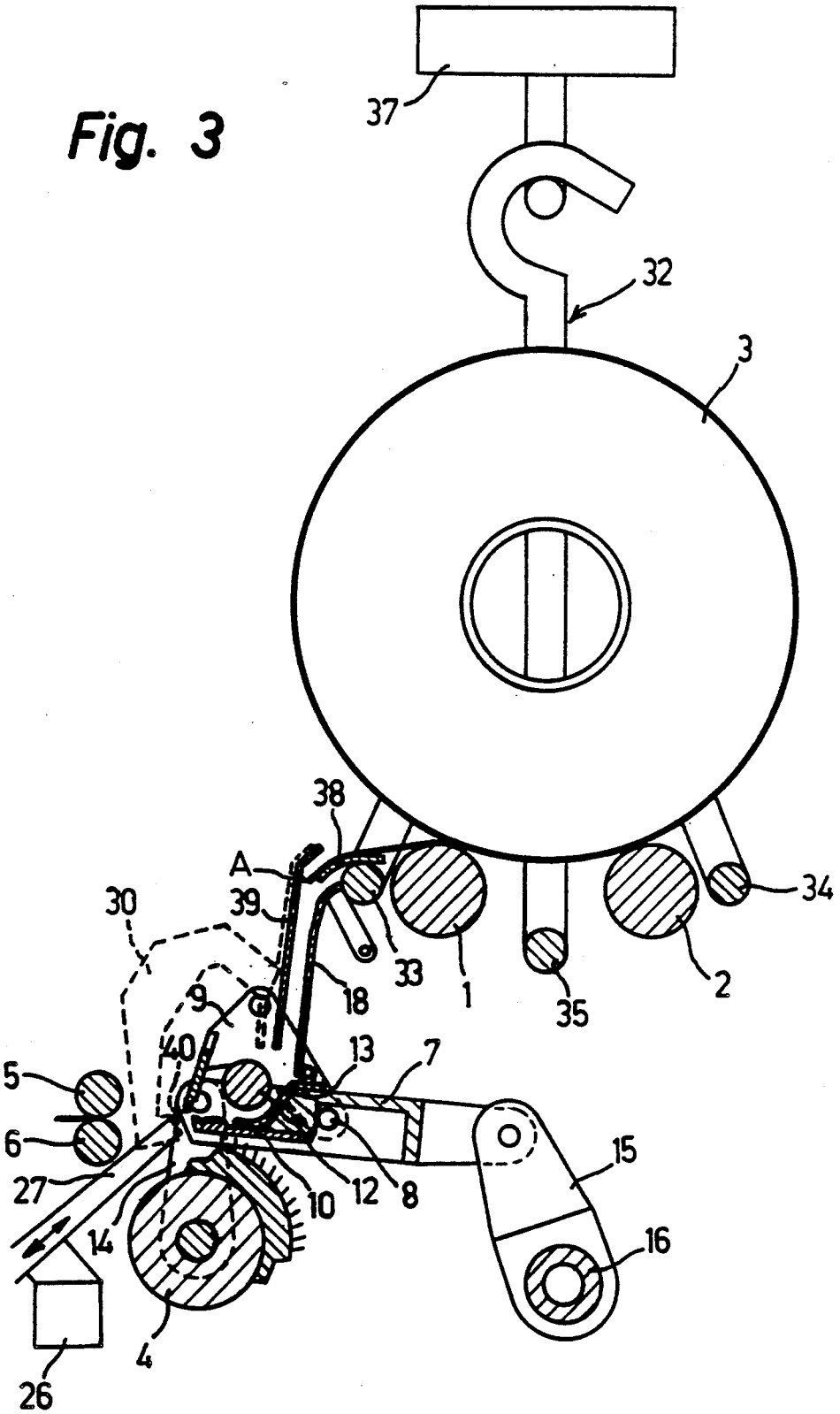
FIG. 3 illustrates a view similar to FIGS. 1 and 2 with a fresh lap roll being put in place.
Figure 4:
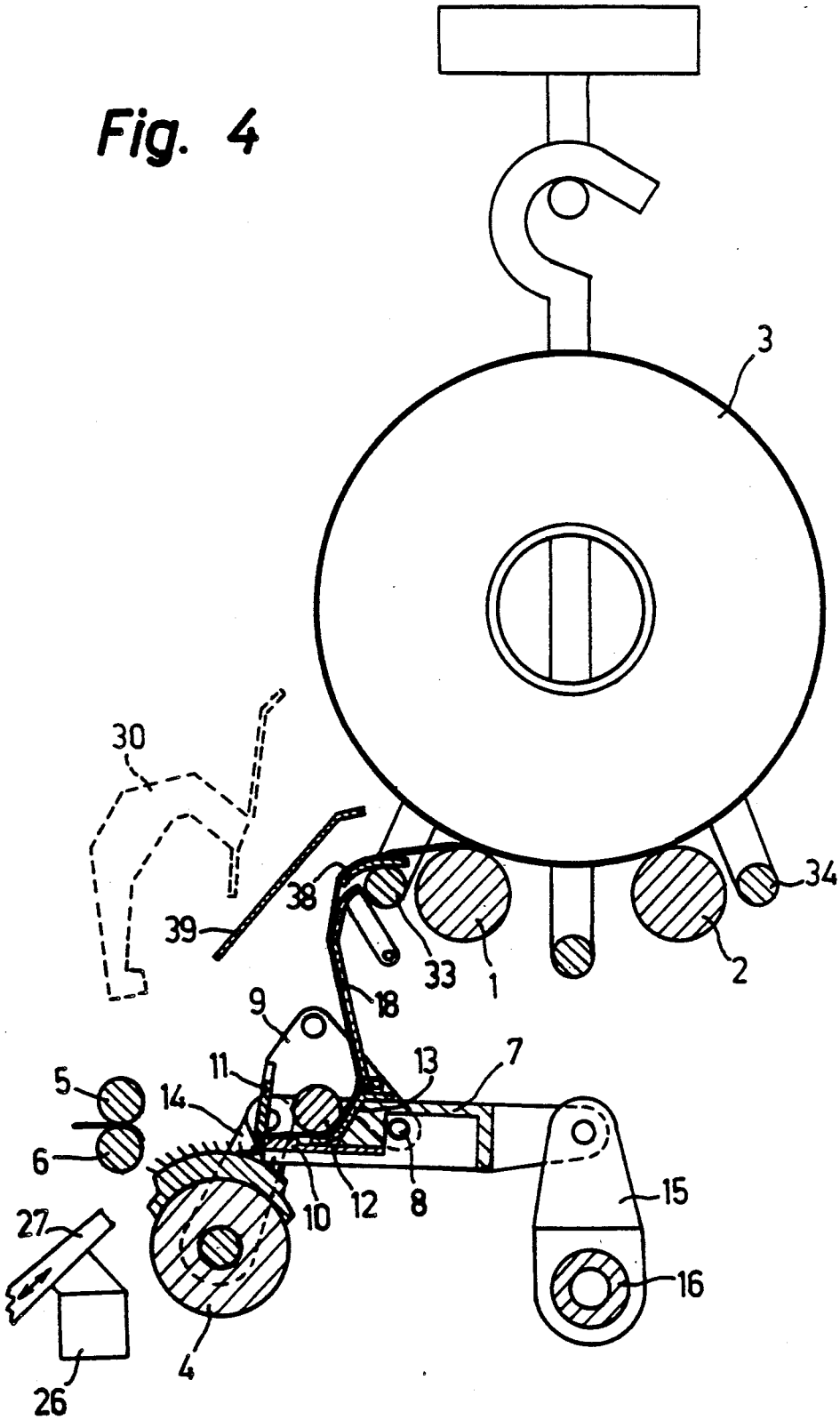
FIG. 4 illustrates a view similar to FIG. 3 with a leading end of a fresh lap being guided into place between the nippers of the combing head in accordance with the invention.

The combing head diagrammatically shown in FIGS. 1 to 4 has carrying and drive means in the form of two parallel rotatable take-up rollers 1, 2 which carry a lap roll 3 when the combing machine is in operation. The combing head also has, in conventional manner, a continuously rotatable combing cylinder 4, two detaching rollers 5, 6 rotatable in a pilgrim step movement and reciprocating nippers comprising a lower nipper frame 7 and two upper nipper arms 9 so connected thereto as to be pivotable around a pivot 8. The lower frame 7 carries a lower nipper plate 10 with which a top nipper plate 11 carried by the arms 9 cooperates. Also, an intermittently rotatable feed roller 12 is disposed in the lower frame 7 and cooperates with a lap-guiding element in the form of a guide plate 13. At the front end, the lower frame 7 is pivotally connected to front supports 14 pivotable around the axis of the cylinder 4 and is pivotally connected at the rear end to pivot arms 15 disposed on a nipper shaft 16. The same is rotated reciprocatingly to reciprocate the nippers 7, between the advanced position, which is shown in FIG. 1 and in which the nippers are open and their nip line K is on the lower plate 10 a short distance behind the detaching rollers 5, 6, and the drawn-back position, which is shown in FIG. 4 and in which the nippers are in the closed state.

A drive means (drive unit) 17 shown diagrammatically as a block in FIG. 1 produces the motions of the rollers 1, 2, cylinder 4, detaching rollers 5, 6 and nipper shaft 16.

In operation, the lap unwound from the roll 3 by rotation of the rollers 1, 2 moves, by way of an entry plate 18 pivoted to the lower frame 7, between the feed roller 12 and the guide plate 13 and is conveyed intermittently by the feed roller 12 to the nip line K. When the nippers 7, 9 are in the drawn-back position shown in FIG. 4, a loading end of the lap in a clamped state between the edges of the plates 10 and 11 and the fringe projecting from the nippers is combed out by the rotating cylinder 4. The nippers 7, 9 then move into the advanced position of FIG. 1 and open and the detaching rollers 5, 6 rotate backwards through a predetermined angle so that the trailing end of the previously formed combed sliver emerges from the nip of the detaching rollers 5, 6 and the leading end of the fringe on the lower plate 10 engages the top of such trailing end. Thereafter, the detaching rollers 5, 6 rotate forwards to engage and detach the fringe from the lap in the nippers 7, 9. Thereafter, the nippers 7, 9 return to their drawn-back position, and so on.

When the lap material has run off the roll 3 completely or substantially completely (as shown in FIG. 1 where virtually only the empty winding tube 19 still remains on the rollers 1, 2), a signal indicating that lap roll changing must proceed is produced on a line 20. In the case of a multihead combing machine, roll changing then preferably proceeds simultaneously in some or all of the heads. The signal on the line 20, such signal being produced, for example, by a photocell 21 which detects that the end of the lap material on the winding tube 19 has passed by, is supplied to control means 22.

The control means 22, which also receives by way of a line 23 a signal indicating the position of a moving part of the combing head, for example, from a position detector 24 associated with the rotating cylinder 4, then actuates a stop motion (which forms part of the control means 22 and is not shown separately) which acts on the drive unit 17 and stops the combing machine after the detaching rollers 5, 6 have detached a fringe from the lap in the nippers 7, 9 and the same have drawn back from their advanced position. The parts of the combing head are then in the positions approximately as shown in FIG. 2, the nippers 7, still being open (if necessary the control means 22 might also actuate a nipper opener not shown for opening the nippers 7, 9 further).

The lap end which is still in the nippers 7, and which extends to the lap roll 3 or tube 19 is then removed. Such removal can be automatic, drive means 26 controlled by way of a line 25 by the control means 22 moving the inlet of a suction means 27 before the nip line K or between the nippers and the detaching rollers 5, 6, as shown diagrammatically in FIG. 2. Thereafter, the rollers 1, 2 rotate in the unwinding direction on their own, while the remainder of the combing machine remains stationary, in order to completely unroll that part of the lap end which is still present on the tube. To produce this rotation of the rollers 1, 2 the drive line between the drive unit 17 and the rollers 1, 2 can comprise an auxiliary drive 28 which is controlled by the control means 22 and which disengages the rollers 1, 2 from the drive unit 17. In order that the lap end may be sucked unhampered into the suction means 27, the control means 22 actuates by way of a line 29 means (not shown) for increasing the distance between the feed roller 12 and the lap-guiding plate 13, for instance, so that the last-mentioned means raises the feed roller 12 into the position shown in FIG. 3. Alternatively, the means controlled by way of the line 29 might rotate the feed roller 12 so that the same conveys the lap to the suction means 27.

A variant of the suction means is shown in chain lines. The alternative suction means 30 are formed with a suction orifice 31 which, when the means 30 are in the position shown in FIG. 2, is disposed near the lap material between the tube 19 and the nippers 7, and intakes the lap end at this place.

After removal of the lap end, the empty winding tube 19 is removed, for example, by means of a conveyor 32 in the form of a stirrup having horizontal carrying rods 33–35 moved by a drive 37 which is shown in block form and which is controlled by the control means 22 by way of a line 3.

The conveyor 32 then moves up a new lap roll 3 and places it, as shown in FIG. 3, on the rollers 1, 2. Conveniently, the new roll 3 is a prepared roll on which the start A of the lap material has a predetermined orientation. This orientation remains unchanged during conveyance because the lap 3 rests on the bars or rods 33, 34 by way of its peripheral surface so that the outermost turn of the lap material cannot slacken. Preferably, the lap start A has already been detached from the roll 3 and is disposed, as shown, in a protected manner on a run-off plate 38 secured to the rod 33. Alternatively, of course, the lap start A could be detached from the roll 3 only in the combing machine, for example, automatically under the control of the means 22 through the agency of a suction nozzle or a blowing nozzle or a knife (not shown).

Means (not shown) controlled by the control means 22 then move a guide plate 39 from the inoperative position of FIG. 1 into the position adjacent the entry plate 18 shown in FIG. 3. The auxiliary drive 28 controlled by the control means 22 then rotates the rollers 1, 2 to unwind lap material from the new roll 3 until the lap start A, which passes through between the guide plate 39 and the entry plate 1 and is sucked in by the suction means 27, has passed beyond the nip line K of the nippers 7, 9. This conveyance of the lap can be boosted by compressed air ejected downwardly by a nozzle (not shown) between the two plates 39 and 18, or by mechanical conveying means (not shown). If the lap start A originally has a predetermined orientation on the roll 3 as previously described, the rolls 1, 2 are simply turned through a predetermined angle until the start A has passed the nip line K. This is particularly advantageous for simultaneous roll changing in a number of combing heads.

To suck in the lap start A towards the nip line, the modified suction means 30 might be used instead of the means 27 if the means 30 are formed in the bottom part with a second suction orifice 40 which, are shown in FIG. 3, can be moved into a position before the nip line K. In this case, the top suction orifice 31 would have to be closed.

The suction means 27 (or 30) are then drawn back into the inoperative position of FIG. 1 and rendered inoperative. A knife or comb can be disposed in the suction orifice of the suction means to sever any excess length of the lap material which has passed beyond the nip line K, to ensure that such excess length enters the suction means. Also, the guide plate 39 moves away from the entry plate 18 and the gap between the feed roller 12 and the guide plate 13 is reduced to a normal value. The control means 22 then switches on the drive unit 17 to restart the combing machine. The nippers 7, 9 move first into their drawback position and close, as shown in FIG. 4. The new lap start, which is clamped fast between the plates 10 and 11 and projects beyond the nip line K, is combed out by the cylinder 4, any surplus length of this start being combed away. If required, the control means 22 can briefly stop the combing machine in the position shown in FIG. 4 and allow the cylinder 4 to perform one revolution or several revolutions on its own. Thereafter, the nippers 7, 9 move into their advanced position shown in FIG. 1 and the combing head resumes normal operation.

Figure 5:
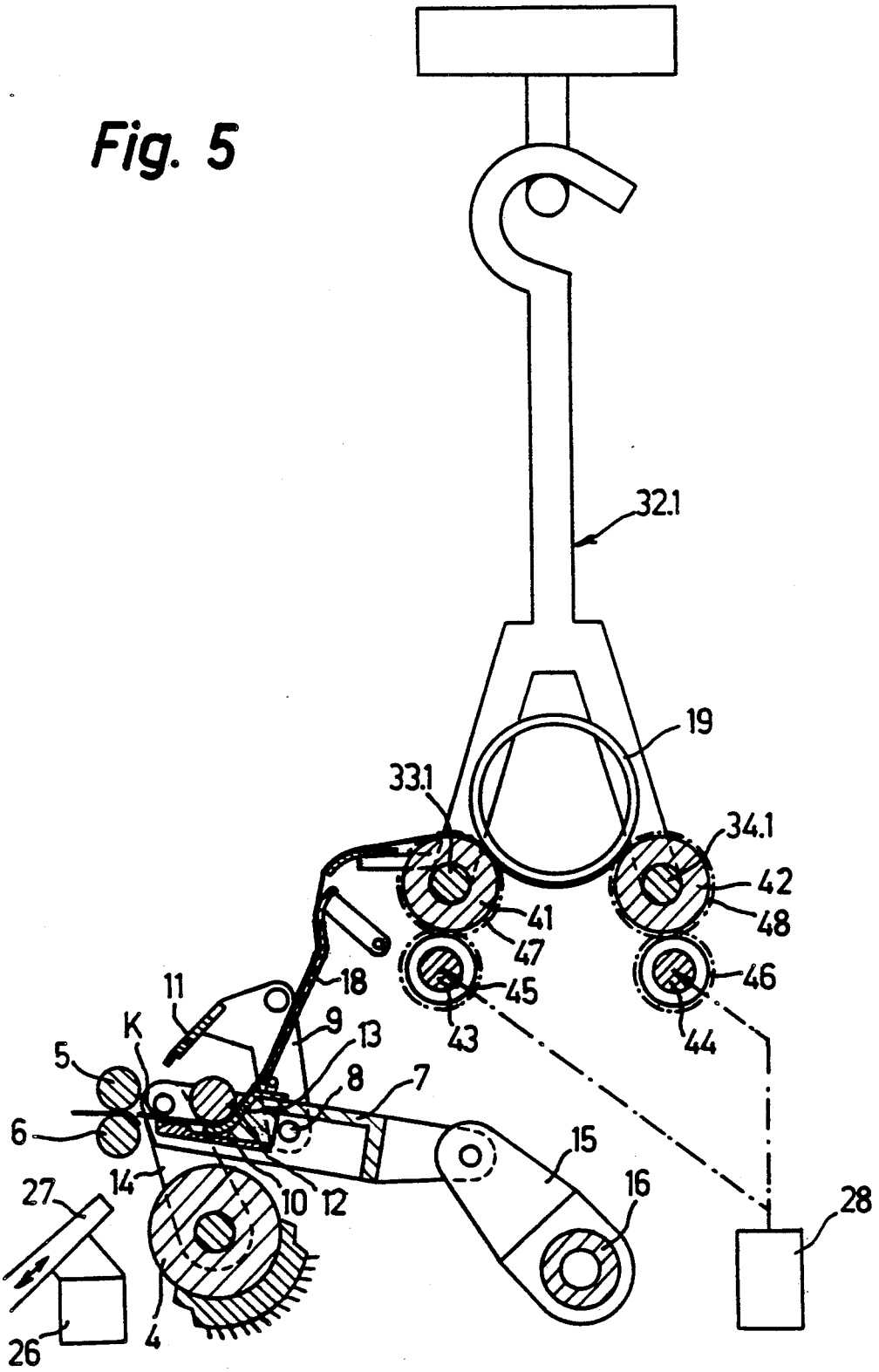
FIG. 5 illustrates a view similar to FIG. 1 of a modified combing head having drive means for driving a lap roll in accordance with the invention.

In the variant shown in FIG. 5, rotatable rolls 41, 42 on which the lap roll rests are disposed on the rods 33.1, 34.1 of the conveyor 32.1. The carrying and drive means of the comb head comprise shafts 43, 44 mounted non-displaceably on the frame 8 carrying respective gears 45, 46 with which respective gears 47, 48 on the respective rollers 41, 42 mesh when the conveyor 32.1 is lowered on to the carrying and drive means.

What is claimed is:

1. A method of changing a lap roll in at least one combing head of a combing machine, said combing head having a lap roll receiving position, a pair of nippers for holding a fringe extending from a leading end of a lap extending from a lap roll in said position, a combing cylinder for combing the held fringe and detaching means for detaching the combed fringe from the nippers; said method comprising the steps of detecting a run-out of the lap from the lap roll;

thereafter stopping the combing head at a time after detachment of a combed fringe by the detachment means;

thereafter removing the reminder of the lap extending between the nippers and the lap roll to empty the lap roll;

removing the empty lap roll and positioning a full lap roll in said receiving position;

directing a fresh lap start from the full lap roll into said nippers; and thereafter re-starting the combing head to effect combing of a fringe of the fresh lap start in said nippers for subsequent delivery to said detaching means.

2. A method as set forth in claim 1 wherein the full lap roll has a fresh lap start of a predetermined orientation.

3. A method as set forth in claim 1 wherein the full lap roll is rotated in said receiving position to unwind a predetermined length of lap therefrom for feeding to said nippers.

4. A method as set forth in claim 1 wherein the remainder of the lap removed from between the nippers and lap roll is drawn off under suction while the lap roll is rotated.

5. A method as set forth in claim 1 wherein said combing cylinder is rotated at least over one revolution prior to re-starting of the combing head.

6. A combing head for a combing machine comprising a lap roll receiving position;

a pair of nippers for holding a fringe extending from a leading end of a lap extending from a lap roll in said position;

means for reciprocating said nippers between an open position wherein said nippers are spaced part to receive a lap therebetween and a closed position wherein said nippers hold a lap therebetween;

a combing cylinder for combing a fringe of lap extending from said nippers in said closed position;

detaching means for detaching a combed fringe from said nippers;

drive means for driving said nippers, combing cylinder and detaching means in synchronism;

stop means for stopping said drive means in response to a run-out of the lap from a lap roll in said receiving position and detachment of a combed fringe by said detachment means;

means for removing the remainder of the lap extending between said nippers and said receiving position in response to stopping of said drive means; and means for directing a fresh lap start from a full lap roll into said nippers with said nippers in said open position prior to re-starting of said drive means.

7. A combing head as set forth in claim 6 which further comprises a conveyor means for positioning a full lap roll in said receiving position.

8. A combing head as set forth in claim 7 which further comprises drive means in said lap roll receiving position for rotating a lap roll therein.

9. A combing head as set forth in claim 6 which further comprises an intermittently rotatable feed roller for feeding a lap between said nippers, a lap-guiding element facing said feed roller to guide a lap therebetween, and means for moving said feed roller relative to said lap-guiding element to increase a space therebetween.

10. A combing head as set forth in claim 6 which further comprises a suction means for movement between said nippers and said detaching means to draw a lap therefrom.

11. A combing head as set forth in claim 6 which further comprises a detector for sensing a run-out of lap from a lap roll in said lap receiving position and emitting a signal in response thereto and a control means responsive to said signal to activate said stop means to stop said drive means.

12. A combing head as set forth in claim 11 which further comprises drive means in said lap roll receiving position for rotating a lap roll therein, said control means being connected to said lap roll drive means to activate said lap roll drive means after placement of a fresh lap roll thereon to unwind a predetermined length of lap therefrom prior to re-starting said drive means.

* * * * *